United States Patent [19]

Matsuhisa et al.

[11] 4,280,693

[45] Jul. 28, 1981

[54] SHEET FEEDING DEVICE FOR PRINTING APPARATUS

[75] Inventors: Koh Matsuhisa, Kanagawa; Mamoru Takezawa, Yokohama; Yoshio Kawajiri, Zama, all of Japan

[73] Assignee: Ricoh Co., Ltd., Japan

[21] Appl. No.: 972,324

[22] Filed: Dec. 22, 1978

[30] Foreign Application Priority Data

Dec. 28, 1977 [JP] Japan ..... 52-157475

[51] Int. Cl.[3] ..... B65H 9/06

[52] U.S. Cl. ..... 271/246; 271/277

[58] Field of Search ..... 271/277, 245, 246; 400/600.2, 600.3, 600.4

[56] References Cited

U.S. PATENT DOCUMENTS

| | | | |
|---|---|---|---|
| 2,744,604 | 5/1956 | Becker | 400/600.2 X |
| 2,984,482 | 5/1961 | Kist | 271/246 X |
| 3,999,749 | 12/1976 | Zambolin | 271/246 |

OTHER PUBLICATIONS

IBM Technical Disclosure Bulletin, vol. 17, No. 5, Oct. 1974, pp. 1263, 1264, "Paper Table Actuated Feed Rollers and Paper Gate", W. F. Klein et al.

IBM Technical Disclosure Bulletin, vol. 18, No. 5, Oct. 1975, pp. 1305, 1306, "Paper Feed", R. D. Mathews.

*Primary Examiner*—Richard A. Schacher

*Attorney, Agent, or Firm*—McGlew and Tuttle

[57] ABSTRACT

In a sheet feeding device for a printing apparatus for feeding one sheet after another to a printing station, a stopper hook is located slightly posterior to point of contact between a platen and a roller or between two rollers brought into and out of pressing contact with each other, and a sheet fed to the printing station is stopped by the stopper hook and has its position corrected, if it has a skew, while the platen and the roller or the two rollers are out of contact with each other. Thus a sheet free from skew is pressed by the roller against the platen or the roller to enable automatic skewless sheet feeding to be effected.

7 Claims, 8 Drawing Figures

SHEET FEEDING DEVICE FOR PRINTING APPARATUS

BACKGROUND OF THE INVENTION

1. Field of the Invention

This invention relates to sheet feeding devices for printing apparatus and more particularly to a sheet feeding device for a printing apparatus which enables skewless sheet feeding to be effected automatically.

2. Description of the Prior Art

In printing apparatus such as typewriters and printers, it is necessary that each sheet which is fed to a platen or to a printing station by the platen be fed straight and have no skew. The usual practice is that a pressing roller maintained in pressing engagement with the platen is released from engagement therewith and a sheet has its position corrected manually if it has a skew.

In recent years, popularization of automation in document production has made it necessary to effect sheet feeding automatically. However, realization of full benefits from automatic sheet feeding has been hampered by the need to correct the position of a sheet manually if the sheet is at an angle.

An increase in the speed at which a printing apparatus is operated has rendered loss of the time which is required for correcting the position of a sheet when it has a skew unacceptable. Proposals have been made to use a method in which the leading edge of a sheet is caused to impinge against the contacting portions of a platen and a pressing roller in pressing engagement with each other, as a means for automatically preventing the skewing of the sheet.

A skew generally occurs in a sheet when it is caught in the nip between the pressing roller and the platen. A skew is produced in a sheet largely because it is difficult to cause the entire leading edge portion of a sheet to be caught at one time time by the platen and pressing roller due to the fact that a slip tends to occur between the sheet and the platen. Thus the method of the prior art in which the leading edge of a sheet is caused to impinge against the contacting portions of the platen and pressing roller is not capable of effectively preventing the skewing of a sheet.

SUMMARY OF THE INVENTION

This invention has as its object the provision of a sheet feeding device for a printing apparatus which is capable of automatically preventing the skewing of a sheet by a simple construction.

The aforementioned object is accomplished according to the invention by providing a sheet feeding device including stopper hook means located in a position slightly posterior to a point of contact between a pair of roller means brought into and out of contact with each other.

The pair of roller means may be formed of a platen and one or a plurality of rollers brought into and out of pressing contact with the platen.

The pair of roller means may be formed of a pair of rollers brought into and out of engagement with each other. When a pair of rollers are used, the pair of rollers and the stopper hook means may be provided in addition to the platen and the roller or rollers brought into pressing contact with the platen.

By timing the feeding of a sheet with the disengaging and engaging of the pair of roller means and the movement of the stopper hook means by mechanical or electric means properly, it is possible to effect sheet feeding without the occurrence of a skew.

Accordingly, an object of the present invention is to provide an apparatus for aligning sheets on a sheet feeding device for feeding a sheet in a sheet path comprising, a drive member movably mounted for feeding a sheet, a pressing member movable into and out of engagement with said drive member for feeding the sheet therebetween when said pressing member is in engagement with said drive member, release means connected to said pressing member for moving said pressing member into and out of engagement with said drive member, a stopper member movable into the feed path of the sheet adapted for engagement with a leading edge of the sheet to stop and align the sheet in its feed path, and stopper member activation means connected to said stopper member for moving said stopper member into the path of the sheet when said pressing member is out of engagement with said drive member, said release means operable to move said pressing member into engagement with said drive member when said stopper member activation means moves said stopper member out of the path of the sheet.

A further object of the present invention is to provide an apparatus for aligning sheets on a sheet feeding device for feeding a sheet in a feed path which is simple in design, rugged in construction and economical to manufacture.

DESCRIPTION OF THE PREFERRED EMBODIMENTS

Figure 1:
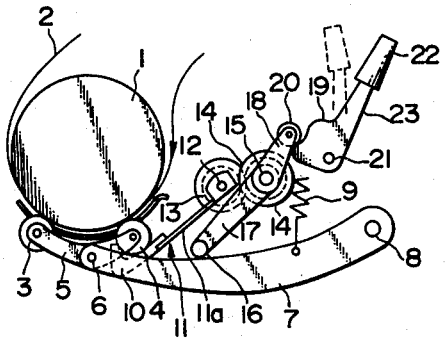
FIG. 1 is a side view of the essential portions of the sheet feeding device comprising one embodiment of the invention.
Figure 2:
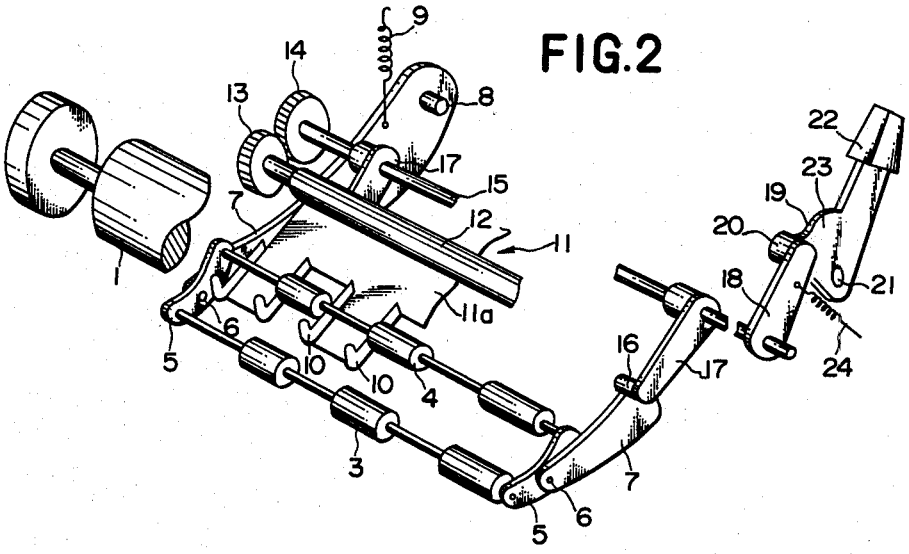
FIG. 2 is a perspective view of the device shown in FIG. 1.

Embodiments of the invention will now be described with reference made to the accompanying drawings. In FIGS. 1 and 2, a sheet 2 is passed around a platen 1 as indicated by an arrow, and the sheet 2 is pressed against the platen 1 by a front pressing roller 3 and a rear pressing roller 4. In this condition, the rotation of the platen 1 is transmitted to the sheet 2 without producing a slip. Platen 1 thus forms a drive member with rollers 3 and 4 being pressing members.

The front pressing roller 3 and rear pressing roller 4 are each supported by a shaft rotatably supported at opposite ends thereof by connecting arms 5 which are pivotally connected, at their substantially central portions, by pins 6 to one end of pressing arms 7 which are rotatably supported at the other end thereof through a support shaft 8 by a frame, not shown, of the sheet feeding device. The pressing arms 7 are urged by the biasing force of resilient means, such as springs 9, to press against the platen 1. More specifically, the biasing force of the springs 9 is transmitted by way of the pressing arms 7 and connecting arms 5 to the front and rear pressing rollers 3 and 4 to bring the latter into pressing contact with the platen 1.

Stopper hooks or members 10 supported by a thin sheet 11*a* having a resilience enabling the sheet 11*a* to act as a plate spring and functioning as stopper hook means 11, are located beneath the platen 1. The stopper hooks 10 are each in the form of a letter L whose short leg is pressed at its upper end against the platen 1 in a position slightly posterior to a point of contact between the rear pressing rollers 4 and the platen 1. The stopper hooks 10 may be formed integrally with the thin metal sheet 11*a* which is secured to a stopper shaft 12.

The stopper shaft 12 is rotatably supported by the frame of the sheet feeding device and has secured to one end thereof a first gear wheel 13 which is in meshing engagement with a second gear wheel 14 secured to one end of a release shaft 15 rotatably supported by the frame of the sheet feeding device.

The release shaft 15 has secured thereto one end of release arms 17 having formed on the other end thereof with projections 16 which are each positioned on the upper surface of one of the pressing arms 7. The release shaft 15 has secured at the other end thereof to one end of a lever 18 having mounted at the other end thereof a roller 20 acting as a follower of a cam 19 which is formed on the upper surface of a release lever 23 pivotally supported by the frame of the sheet feeding device and having a release knob 22. The release shaft 15 is maintained by an elastic biasing force in a position in which it does not actuate the pressing arms 7. In the embodiment shown, a spring 24 is employed to provide such elastic biasing force. However, a spring connected to one of the release arms 17 or the release shaft 15 itself may be used. Shaft 15 with levers 23 and 18 and arms 17 and 7 form release means and shaft 12 with gears 13, 14 form stopper member activation means which are here associated with the release means.

Upon manually moving the release knob 22 from an inoperative position shown in solid lines in FIG. 1 to an operative position shown in dotted lines therein, a force acting on the release shaft 15 to rotate it is produced by the action of the cam 19 and transmitted by way of the roller 20 and lever 18 to the shaft 15. The angular rotation of the release shaft 15 causes the release arms 17 to move the pressing arms 7 downwardly against the biasing force of springs 9, to thereby release the front and rear pressing rollers 3 and 4 from contact with the platen 1.

While the pressing rollers 3 and 4 are being released from contact with the platen 1 by the action of the release arms 17, the rotation of the release shaft 15 is transmitted by way of the second gear wheel 14 and first gear wheel 13 to the stopper shaft 12 and causes the resilient sheet 11 to move upwardly or clockwise in FIG. 1 in swinging motion so as to bring the stopper hooks 10 into resilient contact at their upper ends with the platen 1. The elasticity of the resilient sheet 11*a* enables the upper ends of the stopper hooks 10 to be maintained in intimate contact with the platen 1.

While the stopper hooks 10 are maintained at their upper ends in intimate contact with the platen 1 as aforesaid, the sheet 2 is inserted into its path of travel as guided by guide plates, not shown. The sheet 2 impinges at its leading edge against the stopper hooks 10 and has its position corrected or aligned even if the sheet 2 is skewed in its movement through its path of travel.

If the knob 22 is pressed back to its original position, then the cam 19 acts to cause the release shaft 15 to rotate angularly in the reverse direction to thereby restore the release arms 17 to their original positions. The pressing arms 7 are urged to move in pivotal motion by the biasing force of springs 9 to thereby bring the front and rear pressing rollers 3 and 4 into pressing engagement with the platen 1. At this time, the rear pressing roller 4 presses the sheet 2, which has its leading edge regulated by the stopper hooks 10, against the platen 1 and holds the sheet 2 in a skewless condition. The stopper shaft 12 rotated by way of the gear wheels 13 and 14 restores the resilient sheet 11*a*, which was resiliently bent when the upper ends of the stopper hooks 10 were pressed against the platen 1, to its original position.

After the sheet 2 is positively held between the platen 1 and the rear pressing roller 4, the release shaft 15 further rotates and causes the stopper shaft 12 to rotate so as to thereby release the stopper hooks 10 from intimate contact with the platen 1.

Figure 3:
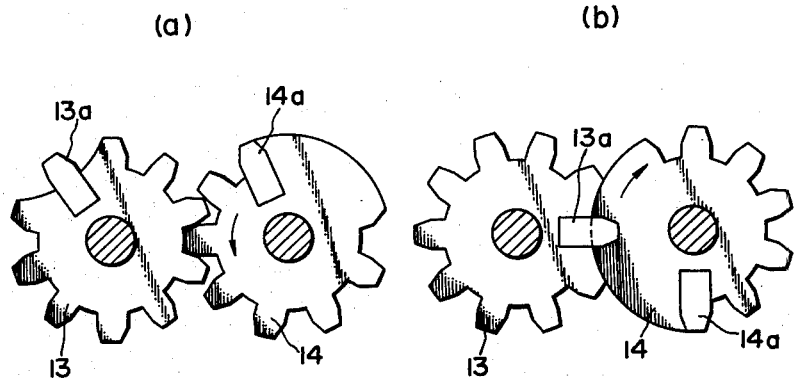
FIGS. 3*a* and 3*b* show one example of a gear wheel having toothless portions, FIG. 3(*a*) showing the pressing rollers at the time when they have begun to be released from meshing engagement with each other and FIG. 3(*b*) showing them at the time when they have begun to be brought into meshing engagement with each other.

The movement of the stopper hooks 10 and the movement of the pressing arms 7 are timed such that if the rotation of the release shaft 15 is immediately transmitted to the stopper shaft 12, the resilient sheet 11*a* may be bent more than is necessary. To avoid this defect, intermittent drive gear wheels, for example gear wheels having toothless portions shown in FIGS. 3(*a*) and 3(*b*) may be used to prevent the rotation of the stopper shaft 12 after the resilient sheet 11 is bent to a desired degree following the engagement of the stopper hooks 10 with the platen 1. FIG. 3(*a*) shows the first gear wheel 13 and second gear wheel 14 in meshing engagement with each other when the pressing rollers 3 and 4 have begun to be released from engagement with the platen 1, and FIG. 3(*b*) shows the two gear wheels 13 and 14 in meshing engagement with each other when the pressing rollers 3 and 4 have begun to be brought into meshing engagement with the platen 1. The first gear wheel 13 and second gear wheel 14 have wide teeth 13*a* and 14*a* respectively which project radially of the gear wheels 13 and 14 for switching between the nontransmitting condition of the toothless portions and the transmitting condition of the toothed portions. Wide teeth 13*a*, 14 only engage each other and no other portions of the gear.

Figure 4:
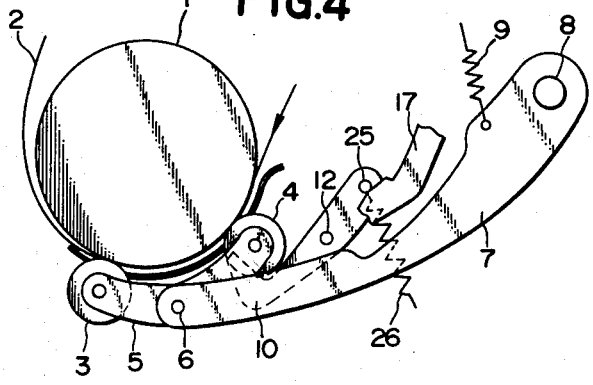
FIG. 4 is a side view of the sheet feeding device comprising another embodiment of the invention.
Figure 5:
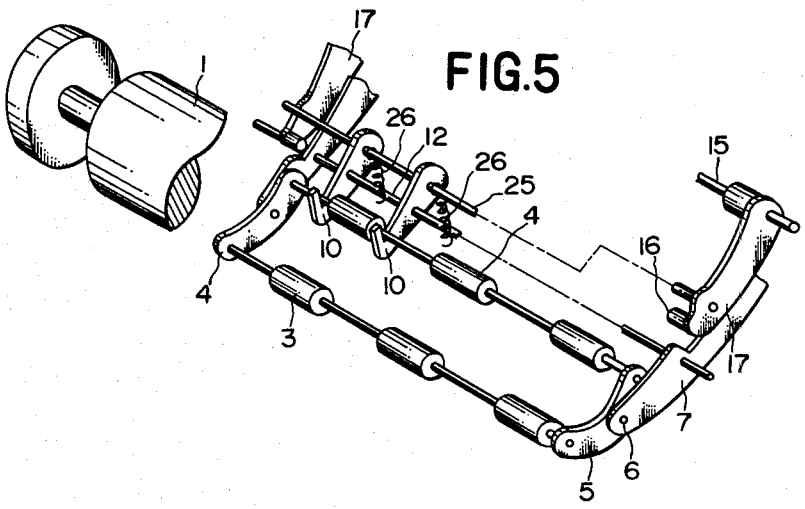
FIG. 5 is a perspective view of the device shown in FIG. 4.

FIGS. 4 and 5 show another embodiment of the invention in which parts similar or corresponding to the parts shown in FIGS. 1 and 2 are denoted by like reference characters and their description is omitted if they are analogous in construction.

The stopper hooks 10 secured to the stopper shaft 12 and each arranged between the two adjacent rear pressing rollers 4, are connected to one another by a release bar 25. The stopper hooks 10 are urged by the biasing force of springs 26 to move toward the platen 1 and this biasing force urges portions of the release lever 25 into pressing contact with the release arms 17.

Although the release shaft 15 of FIG. 5 has a lever 18 secured thereto which is actuated by a release lever 23 like the lever 18 of the embodiment shown in FIG. 1, lever 18 is not shown in FIG. 5.

If a release knob 22 is actuated to pivotally move the release arms 17 counter clockwise about the shaft 15, then the release bar 25 moves in the same direction as the release arms 17 by virtue of the biasing force of springs 26, thereby bringing the stopper hooks 10 into contact with the platen 1. The biasing force of springs 26 has the effect of maintaining the stopper hooks 10 in intimate contact with the platen 1.

Meanwhile the release arms 17 push, by the projections 16, the pressing arms 7 downwardly, thereby releasing the front and rear pressing rollers 3 and 4 from engagement with the platen 1.

The sheet 2 is inserted into its path of movement and caused to impinge at its leading edge against the stopper hooks 10 so that its position may be corrected if it is skewed during its movement through its path of travel.

If the release knob 22 is moved back to its original position by hand, then the release arms 17 pivotally moves clockwise about the release shaft 15, and the pressing arms 7 moved previously to their lower positions by the projections 16 are moved upwardly by the biasing force of springs 9, thereby bringing the front and rear pressing rollers 3 and 4 into pressing contact with the platen 1.

After the front and rear pressing rollers 3 and 4 are brought into pressing engagement with the platen 1, the release arms 17 abut against the release bar 25 and moves it upwardly, thereby releasing the stopper hooks 10 from engagement with the platen 1. When the stopper hooks 10 are released from engagement with the platen 1, the sheet 2 is already held in pressing engagement with the platen 1 by the rear pressing rollers 4, there is no possibility of the sheet 2 becoming skewed.

If the platen 1 is rotated after the sheet 2 is pressed against the platen 1 by the rear pressing rollers 4 and the stopper hooks 10 are released from engagement with the platen 1, the sheet 2 is frictionally fed in the embodiment shown in FIG. 4 as well as in FIG. 1, so that the sheet 2 is moved forwardly by passing between the front pressing rollers 3 and the platen 1.

If the stopper hooks 10 are loosely fitted over the stopper shaft 12 so that the former can rotate relative to the latter, if the openings formed in the stopper hooks 10 to permit the release bar 25 to extend therethrough have a sufficiently large size to permit play to exist between the hooks 10 and the bar 25, and if the springs 26 are connected to the respective stopper hooks 10, it is possible to permit all the stopper hooks 10 to be positively maintained in pressing engagement with the platen 1 without requiring to provide precision finishes to the parts.

Figure 6:
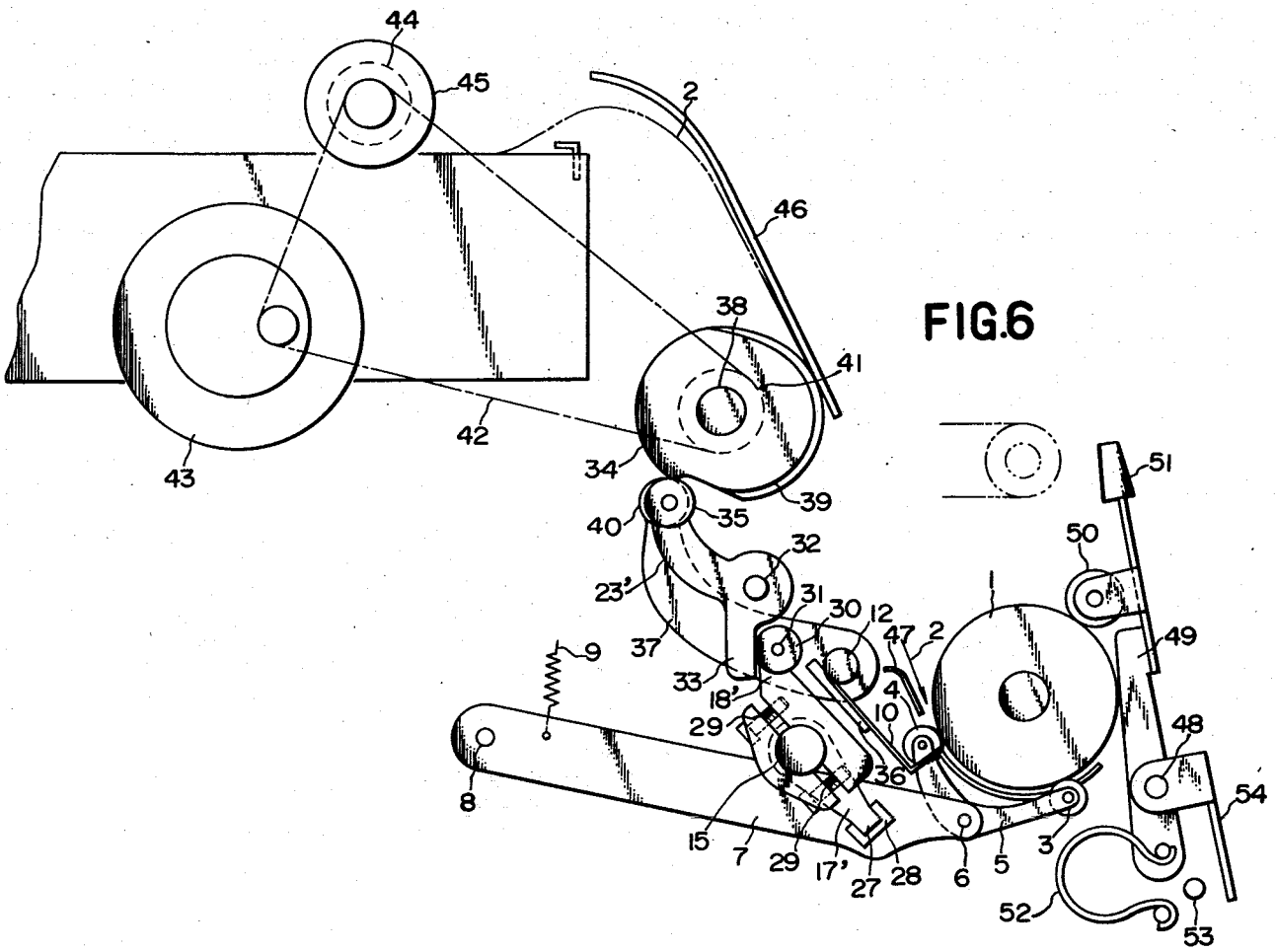
FIG. 6 is a side view of the sheet feeding device comprising still another embodiment of the invention.

In still another embodiment shown in FIG. 6, the release arms for moving the pressing arms 7 are, unlike the corresponding parts shown in FIGS. 1 and 4, in the form of release arms 17' each formed at the forward end with a lug 27 adapted to extend into an opening 28 formed in one of the pressing arms 7 and secured to the release shaft 15 having a lever 18' detachably connected thereto by screws 29, 29. The lever 18' has a roller 30 rotatably supported at its free end by a pin 31 a roller 30 which is positioned against an actuating portion 33 of a release lever 23' pivotally supported by a shaft 32. The release lever 23' rotatably supports a roller 35 adapted to be positioned against a first cam 34 for the rollers to act as a follower thereof.

The stopper hook 10 is in the form of a plate spring and supported by a bracket 36 secured to the stopper shaft 12.

The stopper shaft 12 has secured thereto a stopper lever 37 which rotatably supports a roller 40 at its free end formed as a cam follower and adapted to be positioned against a second cam 39 for the stopper secured to a cam shaft 38 which also supports the cam 34 for the rollers.

The shaft 38 having the cams 34 and 39 secured thereto is connected through a clutch 41 by pulleys and a timing belt 42 to an output shaft of a motor 43. A sheet feeding roller 44 for feeding sheets from a cassette or other sheet feeding means in the sheet feeding station may be driven, like the shaft 38, by the motor 43. The sheet feeding roller 44 is connected through a clutch 45 to the pulleys over which the timing belt is trained.

The operation of the sheet feeding device shown in FIG. 6 will be described in relation to the printing apparatus.

Upon a printing command being given by a control, the clutch 45 is engaged to rotate the sheet feeding roller 44 to separate a sheet 2 from a stack of sheets. The separated sheet 2 is delivered by a guide 46 to a sheet feeding path.

The arrival of the fed sheet 2 at a predetermined position or the lapse of a predetermined time after the sheet 2 is fed is detected to engage the clutch 41 and rotate the shaft 38. The rotation of the shaft 38 rotates the cam 34 for the rollers and the cam 39 for the stopper.

The rotation of the cam 34 for the rollers causes the release lever 23' to move the pivotal motion about the shaft 32, and the actuating portion 33 of the release lever 23' rotates the release shaft 15 by way of the lever 18'. The rotation of the release shaft 15 causes the release arms 17' to move in pivotal motion and bring the lug 27 at the forward end of each release arm 17' into engagement in the opening 28 formed in one of the pressing arms 7. This results in the pressing arms 7 rotating clockwise about the shaft 8, thereby bringing the front and rear pressing rollers 3 and 4 out of engagement with the platen 1.

At the same time, the cam 39 for the stopper rotates and causes the stopper lever 37 to rotate the stopper shaft 12, thereby bringing the stopper hooks 10 into abutting engagement with the platen 1.

After the stopper hooks 10 have been brought into abutting engagement with the platen 1, the sheet 2 passes between a deflector 47 and the platen 1 and impinges on the stopper hook 10. After the sheet is further fed and loosened, the clutch 45 disengaged to stop the feeding of the sheet 2. Thus the sheet is fed a predetermined amount.

While the cams 34 and 39 further rotate, the release lever 23' is first restored to its original position, so that the front and rear pressing rollers 3 and 4 cooperate with the platen 1 to hold therebetween the sheet 2 in a skewless condition. After the sheet 2 is held by the rear pressing roller 4, the stopper lever 37 is restored to its original position to thereby release the stopper hooks 10 from engagement with the platen 1. Thus the clutch 41 is disengaged after the cams 34 and 39 have made one complete revolution. Control can be readily effected if a single-rotation clutch is used as the clutch 41.

A paper bail is released from engagement with the platen 1 by the action of the cam or other means, not shown, while the cams 34 and 39 are rotating. The paper bail includes paper bail arms 49 pivotally supported by a shaft 48, rollers 50 each rotatably supported by one of the paper bail arms 49 for pressing the sheet 2 against the platen 1, and a knob 51 secured to one of the paper bail arms 49. By pushing the knob 51 as by the cam, it is possible to release the rollers 50 from engagement with the platen. Click springs 52 are attached to the paper bail arms 49 so as to keep the paper bail in a released position in which the rollers 50 are released from engagement with the platen 1 and in a pressing position in which the rollers 50 are in pressing engagement with the platen 1. If necessary, the range of movement of the paper bail may be restricted by a stopper 53 cooperating with a stopper lever 54 secured to one of the paper bail arms 49.

When the shaft 38 completes one revolution while the paper bail is released from engagement with the platen 1, a rotation completion signal is produced to actuate the platen 1 so as to move the sheet upwardly in front of a printer head, not shown, and becomes stationary in a position which is beyond a position in which the sheet is kept by the paper bail. Thus the sheet is fed a predetermined amount by the platen 1.

Upon completion of the feeding of the sheet a predetermined amount by the platen 1, the knob 51 of the paper bail is restored to its original position and the rollers 50 hold the sheet on the platen 1. Thus the sheet is ready to print, and then the printer head is actuated to perform a printing operation as desired.

After the sheet on which printing has been made is discharged from the printing station, the aforementioned series of steps are repeated to feed the next following sheet to the printing station.

Figure 7:
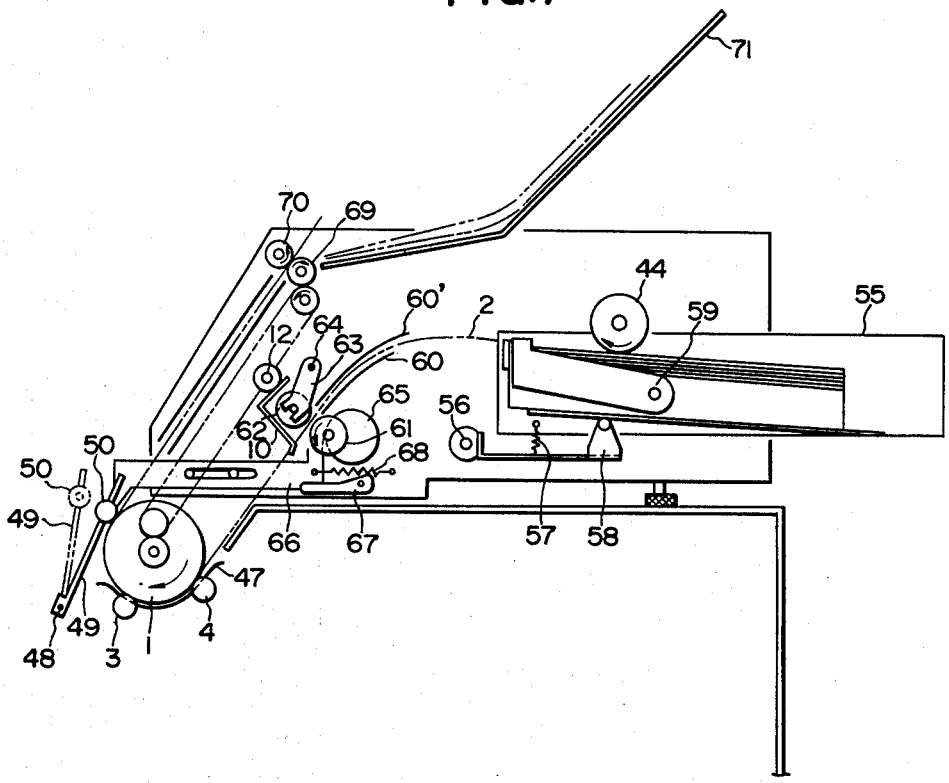
FIG. 7 is a side view of the sheet feeding device comprising a further embodiment of the invention.

FIG. 7 shows a further embodiment of the invention which differs from the embodiments described previously by referring to FIGS. 1 to 6 in that correction of the position of sheets to remove a skew therefrom is carried out in a sheet feeding roller section located anterior to a platen section in which a skew removing operation is carried out in other embodiments. In FIG. 7, parts similar or corresponding to those shown in FIGS. 1 to 6 are designated by like reference characters.

Referring to FIG. 7, sheets 2 contained in a cassette 55 and moved upwardly by a cassette pressor 58 pivotally supported by a shaft 56 and subjected to the biasing force of a spring 57 are fed one by one by the sheet feeding roller 44 cooperating with a separator 59 pivotally supported by the cassette 55. A sheet 2 fed in this way is guided by guide plates 60 and 60' and impinges on the stopper hook 10 when the sheet 2 is fed a predetermined amount as described by referring to the embodiment shown in FIG. 6.

The stopper hook 10 is supported by the stopper shaft 12 connected to a stopper magnet as through a lever, not shown. Energization of the stopper magnet moves the stopper shaft 12 in reciprocatory pivotal movement to thereby move the stopper hook 10 between a locked position and an unlocked position.

While the sheet 2 is being fed by the sheet feeding roller 44, the stopper hook 10 is kept in the locked position and a delivery roller 61 located immediately before the stopper hook 10 is released from contact with a keep roller 62. The keep roller 62 pressed by the delivery roller 61 is supported by a lever 63 which in turn is pivotally supported by a shaft 64 and can be moved in pivotal reciprocatory movement as through a lever, not shown, by a pressure applying magnet. While the sheet feeding roller 44 is in operation, the keep roller 62 is moved away from the delivery roller 61 by the action of the pressure applying magnet. In this embodiment, roller 61 forms the drive member with roller 62 being the pressing member.

The sheet 2 fed from the cassette 55 passes between the delivery roller 61 and keep roller 62 and impinges on the stopper hook 10 to have its position corrected if it has a skew. Then the pressure applying magnet is energized to move the keep roller 62 into contact with the delivery roller 61 to hold the sheet 2 therebetween. Then the stopper magnet is energized to move the stopper hook 10 to the unlocked position to release the leading edge of the sheet 2. Simultaneously as the movement of the stopper hook 10 to the unlocked position, a clutch magnet for the delivery roller 61 is energized to rotate the delivery roller 61 to deliver the sheet 2.

The platen 1 is rotated with a slight time lag behind the rotation of the delivery roller 61. The sheet 2 is inserted between the platen 1 and rear pressing roller 4 while being guided by a guide. The delivery roller 61 stops rotating after it has rotated a required amount or it has made two complete revolutions, for example, and the leading edge portion of the sheet 2 is bitten by the platen 1 and the rear pressing roller 4. The delivery roller 61 and keep roller 62 still hold the sheet therebetween even if the roller 61 becomes stationary and applies the brake to the sheet 2. Thus, even if the platen 1 slips and a skew is produced in a portion of the sheet 2 which is held between the platen 1 and rear pressuring roller 4, the sheet 2 is held by the delivery roller 61 and keep roller 62 in a skewless condition, so that the skew in the portion of the sheet 2 disposed between the platen 1 and rear pressing roller 4 can be automatically removed.

The platen 1 stops rotating with a slight time lag behind the termination of rotation of the delivery roller 61. Thereafter the pressure applying magnet is de-energized to move the keep roller 62 away from the delivery roller 61. Meanwhile the paper bail arms 49 is moved, as by a lever 66 moved in pivotal reciprocatory movement by an eccentric cam 65, to a position in which it is out of contact with the platen 1 and latched in position by a latch 67. A carriage for supporting the printer head is moved to the center and held in position.

The platen 1 is rotated to move the sheet 2 to a printing position in which the sheet 2 is held stationary. Then the latch 67 is deactuated by a magnet, not shown, to permit the lever 66 to be restored to its original position by the biasing force of a spring 68, so as to bring the paper bail arms 49 into pressing contact with the platen 1 with the sheet 2 held therebetween.

A printing command is given to print the sheet 2.

Upon completion of printing, the platen 1 is rotated to discharge the sheet 2 which conveyed in the nip between stacker rollers 69 and 70 which eject the sheet 2 onto a stacker 71.

According to the invention, a stopper hook is provided in a position slightly posterior to a point of contact between a pair of rollers, brought into pressing contact with each other to forcedly deliver a sheet, which rollers may be a platen and a pressing roller or a delivery roller and a keep roller, and a sheet is made to impinge on the stopper hook to positively remove a skew, if there is any, from the sheet while the two rollers are away from each other. The movement of the rollers and stopper hook is controlled mechanically or electrically to time the pressing and holding operation properly, by the rollers, of the sheet from which a skew has been removed with the movement of the stopper hook to its unlocked position, thereby holding the sheet in a skewless condition at all times. Also, the position in which the sheet is held by the rollers in contact with each other and the position in which the sheet impinges on the stopper hook are close to each other, so that it is possible to eliminate the danger that a skew which may be produced by the flexing of the sheet during its movement from the position in which the sheet impinges on the stopper hooker to the position in which it is held by the rollers pressing against each other due to the long distance between the two positions remains in the sheet, in spite of the fact that a skew in the sheet has been removed when the sheet has impinged on the stopper hook.

While specific embodiments of the invention have been shown and described in detail to illustrate the application of the principles of the invention, it will be understood that the invention may be embodied otherwise without departing from such principles.

What is claimed is:

1. A sheet feeding device for a printing apparatus comprising:

a pressing roller operable to be brought into and out of pressing contact with a platen;

stopper hook means located in a position in which a sheet impinges thereon and comes into contact therewith after the sheet has moved a small distance between said platen and said roller with said roller out of contact with said platen;

means mounting said stopper hook means for movement from a position in which the sheet impinges thereon and comes into contact therewith, with said stopper hook means in contact with said platen and said platen and said roller are out of pressing contact with each other, to a position out of contact with the sheet and said platen only after said roller has come into contact with said platen to hold the sheet;

one additional roller operable to be brought into and out of contact with said platen, said stopper hook means located midway between said first-mentioned and additional roller in a path of movement of the sheet fed to said platen, and;

a stopper shaft supporting said stopper hook means and pressing arm means supporting one of said first mentioned and additional roller and capable of moving in pivotal movement in a predetermined range, connected together by transmitting and connecting means; said transmitting and connecting means connecting together said stopper hook means and said pressing arm means comprising a first gear wheel secured to said stopper shaft supporting said stopper hook means, a second gear wheel supported by a release shaft and in meshing engagement with said first gear wheel, release arm means secured to said release shaft and moving in pivotal movement as said second gear wheel rotates, resilient means forcing said pressing arm means against said release arm means by its biasing force, and said first gear wheel and said second gear wheel are in the form of an intermittent drive gear.

2. A sheet feeding device as set forth in claim 1, wherein said stopper hook means comprises a resilient sheet supported by said stopper shaft, and hooks supported at the forward end of the resilient sheet, so that the stopper hook means can move in a predetermined range.

3. An apparatus for aligning sheets on a sheet-feeding device for feeding a sheet in a feed path comprising:

a drive member movably mounted for feeding a sheet;

a pressing member movable into and out of engagement with said drive member for feeding the sheet therebetween when said pressing member is in engagement with said drive member;

release means connected to said pressing member for moving said pressing member into and out of engagement with said drive member;

a stopper member movable into the feed path of the sheet adapted for engagement with a leading edge of the sheet at a position downstream of said pressing member to stop and align the sheet in its feed path; and stopper member activation means connected to said stopper member for moving said stopper member into and out of the path of this sheet, said stopper member activation means operable to move said stopper member into the path of the sheet when said pressing member is out of engagement with said drive member to engage a leading edge of the sheet, said release means operable to move said pressing member into engagement with said drive member to hold the sheet when said stopper member is still in engagement with the sheet and thereafter is moved out of the feed path of the sheet; said drive member comprising a rotatably mounted platen, said pressing member comprising front and rear pressing rollers rotatably mounted and abutable against said platen for moving the sheet in its feed path; said release means comprising a pivotally mounted pressing arm connected to said front and rear pressing rollers, a spring biasing said pressing arm to engage said front and rear pressing rollers against said platen, a release shaft rotatably mounted adjacent said pressing arm having a release arm engageable with said pressing arm, and a release lever adapted for rotating said release shaft and moving said pressing arm against the bias of said spring to disengage said front and rear pressing rollers from said platen; said stopping member activation means comprising a rotatably mounted stopper shaft, said stopping member comprising a plurality of hooks disposed transversely across the feed path of the sheet and connected to said stopper shaft; a first gear connected to said stopper shaft and a second gear connected to said release shaft meshed with said first gear so that a rotation of said release shaft for disengaging said front and rear pressing rollers from said platen rotates said stopper shaft for moving said plurality of hooks into the path of the sheet and against said platen in an area between said front and rear pressing rollers.

4. An apparatus according to claim 3, wherein said stopper member further comprises a spring metal sheet connected to said plurality of hooks for resiliently biasing said leg portions of said hooks against said drive member when said stopper member is moved into the feed path of the sheet.

5. An apparatus according to claim 3, wherein said first and second gears include toothless portions thereon engageable with each other so that a rotation of said second gear imparts a rotation to said first gear only for a portion of the rotation of said second gear.

6. An apparatus for aligning sheets on a sheet-feeding device for feeding a sheet in a feed path comprising:

a drive member movably mounted for feeding a sheet;

a pressing member movable into and out of engagement with said drive member for feeding the sheet therebetween when said pressing member is in engagement with said drive member;

release means connected to said pressing member for moving said pressing member into and out of engagement with said drive member;

a stopping member movable into the feed path of the sheet adapted for engagement with a leading edge of the sheet at a position downstream of said pressing member to stop and align the sheet in its feed path; and stopper member activation means connected to said stopper member for moving said stopper member into and out of the path of this sheet, said stopper member activation means operable to move said stopper member into the path of the sheet when said pressing member is out of engagement with said drive member to engage a leading edge of the sheet, said release means operable to move said pressing member into engagement with said drive member to hold the sheet when said stopper member is still in engagement with the sheet and thereafter is moved out of the feed path of the sheet; said drive member comprising a rotatably mounted platen, said pressing member comprising front and rear pressing rollers rotatably mounted and abutable against said platen for moving the sheet in its feed path; said release means comprising a pivotally mounted pressing arm connected to said front and rear pressing rollers, a spring biasing said pressing arm to engage said front and rear pressing rollers against said platen, a release shaft rotatably mounted adjacent said pressing arm having a release arm engageable with said pressing arm, and a release lever adapted for rotation said release shaft and moving said pressing arm against the bias of said spring to disengage said front and rear pressing rollers from said planten; a motor; a cam shaft rotatable by said motor; a first cam connected to said cam shaft; and a cam follower roller connected to said release lever engaged with said front and rear pressing rollers into and out of engagement with said platen with the rotation of said motor.

7. An apparatus according to claim 6, wherein said stopper member activation means comprises a stopper shaft, said stopper member comprising a plurality of hooks disposed transversely across the feed path of the sheet and connected to said stopper shaft, a pivotally mounted stopper lever connected to said stopper shaft, a second cam on said cam shaft, and a cam follower connected to said stopper lever engaged with said second cam for moving said plurality of hooks into the feed path of the sheet and into engagement with said platen in an area thereof adjacent said rear pressing roller and between said front and rear pressing rollers when said release shaft is rotated to move said front and rear pressing rollers out of engagement with said platen.

* * * * *